United States Patent [19]

Tachikawa et al.

[11] Patent Number: 4,719,955

[45] Date of Patent: Jan. 19, 1988

[54] BLIND

[75] Inventors: Koui Tachikawa; Yuuichi Miura, both of Tokyo; Masaharu Kawashima; Satoru Ogawa, both of Naruto, all of Japan

[73] Assignee: Tachikawa Corporation, Tokyo, Japan

[21] Appl. No.: 874,580

[22] Filed: Jun. 16, 1986

[30] Foreign Application Priority Data

| | | | |
|---|---|---|---|
| Jun. 28, 1985 | [JP] | Japan | 60-99672[U] |
| Jun. 28, 1985 | [JP] | Japan | 60-99673[U] |
| Aug. 30, 1985 | [JP] | Japan | 60-133603[U] |
| Sep. 24, 1985 | [JP] | Japan | 60-145384[U] |
| Oct. 16, 1985 | [JP] | Japan | 60-158170[U] |
| Nov. 15, 1985 | [JP] | Japan | 60-176432[U] |
| Nov. 21, 1985 | [JP] | Japan | 60-179498[U] |
| Dec. 3, 1985 | [JP] | Japan | 60-186470[U] |

[51] Int. Cl.[4] ..... E06B 9/30

[52] U.S. Cl. ..... 160/168 R; 160/176 R; 160/178 R

[58] Field of Search ..... 160/176 R, 176 B, 177, 160/178 C, 168 R, 168 A, 170; 248/222.1, 27.1

[56] References Cited

U.S. PATENT DOCUMENTS

| | | | |
|---|---|---|---|
| 2,175,532 | 10/1939 | Kuyper | 160/176 X |
| 2,224,712 | 12/1940 | Balthasar | 160/176 |
| 2,369,079 | 2/1945 | Schaefer | 160/176 |
| 2,948,141 | 8/1960 | Vahlstrom | 248/27.1 X |
| 3,194,366 | 7/1965 | Hensel | 160/173 X |
| 4,327,797 | 5/1982 | Nakajima et al. | 160/178 C X |
| 4,406,319 | 9/1983 | McNiel et al. | 160/177 |
| 4,522,245 | 6/1985 | Anderson | 160/177 |

FOREIGN PATENT DOCUMENTS

| | | | |
|---|---|---|---|
| 2142071 | 1/1985 | United Kingdom | 160/178 C |

*Primary Examiner*—Ramon S. Britts
*Assistant Examiner*—David M. Purol
*Attorney, Agent, or Firm*—Stephen G. Rudisill

[57] ABSTRACT

Relates to a blind, comprising a head box, an operating rod dropped from one side of the head box, an angle control shaft in the head box which is driven to rotate by the operating rod, a multiplicity of slats controlled for angle by rotations of the angle control shaft, a slat angle controller having a gear mechanism provided between the operating rod and the angle control shaft, the gear mechanism comprising a first gear shaft extending diagonally in section of the head box, a second gear shaft extending longitudinally of the head box, and gears coupling the first and second gear shafts.

8 Claims, 31 Drawing Figures

BLIND

BACKGROUND OF THE INVENTION

1. Field of the Invention

The present invention relates to a blind.

2. Description of the Related Art

In a blind, there is provided a slat angle controller for controlling angles of a slat, which is configured to have a worm mechanism 203 interposed, as shown in FIG. 29, between an operating rod 201 and an angle control shaft 202, thereby transferring a turning force of the operating rod 201 to the angle control shaft 202, and the angle control shaft 202 in a head box 204 is rotated to a slat angle control by turning the operating rod 201 dropped from one side of the head box 204. Then, there is such type of slat elevator for operating slats vertically, wherein a multiple stage of slats are inserted in an elevating cord of a blind which is dropped from the head box and the lower ends are locked on a bottom rail, the elevating cord is operated to move the bottom rail vertically, thereby elevating the slats. For mounting a lower end of the elevating cord on the bottom rail open upward, a mounting member 302 locking the lower end of an elevating cord 301 as shown in FIG. 30 is fitted in a mounting hole 304 of a bottom rail 303 from under the bottom rail 303, or the elevating cord 301 is inserted in the base of the bottom rail 303 as shown in FIG. 28, and then a covering member 305 for the elevating cord 301 is fitted in a mounting hole 306 of the bottom rail 303 from under the bottom rail 303. A slat driving device such as slat angle controller, slat elevator or the like is fitted and so mounted in a mounting hole provided on the head box.

Then, for preventing the slat from descending on its dead weight when the elevating cord is not operated, a dead weight drop preventer for preventing the elevating cord from being drawn into the head box when the elevating cord is not operated is provided on the head box at a position where the elevating cord is hung. In such dead weight drop preventer a fixed roller and a moving roller are supported within a case so as to prevent the elevating cord thereon from being drawn into the head box. Then, the case is fixed on the head box by means of a pin supporting the moving roller within the case and distributing a plurality of elevating cords hung from the case.

On the other hand, a blind has the head box mounted on an upper frame of window or suchlike generally, a multiple stage of slats are hung and supported from the head box through a ladder cord, however, an extraction port for elevating cord, angle controlling cord and others is exposed on a front of the head box to spoil an interior look, and even from controlling the slat vertically for angle to keep the blind closed full, there is produced a clearance between the head box and the uppermost stage slat, and thus the extraneous light leaks through the clearance. Now, therefore, there is proposed a head box cover supporting the slats along the front of the head box so as to cover the head box and the clearance produced as above. That is, a slat same in shape as the slat supported on the ladder cord is supported vertically along the front of the head box by a slat mounting member fixed on a fitting metal of the head box so as to cover the head box and the lower clearance.

Further, what is disclosed by Japanese Utility Model Laid-Open No. 68098/1982 is configured such that the slat mounting member is fixed on the head box, the head box is mounted on a ceiling surface or somewhere suitable, and a plurality of slats are installed in a slat mounting area, thereby screening the front portion of the head box.

Then, the above-described blind involves the following problems.

A recent tendency is such that the blind is designed to a thin type from having a slat contracted in width, and a head box of such blind is also miniaturized according to the slat. However, in the slat angle controller mentioned above, a worm wheel 205 is fitted in the angle control shaft 202 positioned almost at the center of the head box 204 as shown in FIG. 29, and a worm 206 is engaged with a side of the worm wheel 205, therefore if the head box 204 is miniaturized, such worm mechanism 203 becomes hard to be enclosed in the head box 204.

Then, in an elevating cord mounting structure shown in FIG. 30, the lower end of an elevating cord 301 is exposed to the base of the bottom rail 303 to spoil an interior look, and in a mounting structure shown in FIG. 31, a work for knotting a nose of the elevating cord 301 after the elevating cord 301 is inserted in the base of the bottom rail 303 an further fitting the covering member 305 in the mounting hole 306 becomes complicate and troublesome.

As for the slat driving device fitted in the head box as described above, the slat driving device itself is sized to fit in with the head box, or the slat driving device is fixed on the head box with a screw or the like so that it is positioned in the head box stably without working loose at the time of operation, and thus an assembling involves troublesomeness.

Then, in the above-described dead weight drop preventer, it is necessary for mounting on the head box that the case is installed at a predetermined position of the head box, that the distributing pin is inserted in the case within the head box with a moving roller positioned within the case, that the case is fixed on the head box with the single distributing pin, and that the moving roller is supported within the case at the same time. The above-mentioned mounting work involves a troublesomeness consequently.

Further in the blind described above, an interior look will be spoiled by actuators which are exposed on the front surface of the head box. Thus, it is conceivable that the actuators be unified to the same color as the blind, however, if the actuators consist of a metal, then it is difficult to unify each metallic part to the same color as the head box and the slat.

In the head box cover mentioned above, it is necessary to mount the head box on a ceiling surface or somewhere suitable with the slat mounting member mounted on the head box beforehand, therefore the slat mounting member is obstructive to bring about a trouble at the time of mounting work.

Further, in the head box cover, the slats are supported on a support mean somewhat downward from the front of the head box, therefore when the slat angle controlling rod dropped from the head box is operated, the rod comes in contact with a lower edge of the slats supported in front of the head box or a lower edge of the mounting member for supporting the slats, thus causing a trouble for operation.

SUMMARY OF THE INVENTION

An object of the invention is to provide a blind provided with a gear mechanism for a slat angle controller which can easily be contained in a miniaturrized head box.

Another object of the invention is to provide a blind wherein a slat driving device can easily be mounted to a head box.

Another object of the invention is to provide a blind allowing the lower end of an elevating cord to be mounted easily on a bottom rail and provided with an elevating cord locking device fine in appearance.

Another object of the invention is to provide a blind wherein a knot can be prevented from coming off a mounting member when the mounting member is fitted on a bottom rail.

Another object of the invention is to provide a blind wherein a dead weight drop preventer can easily be mounted, and the preventer can be kept from being large-sized.

Another object of the invention is to provide a blind wherein a presence of a slat driving device is inconspicuous and thus an interior looking can be enhanced.

Another object of the invention is to provide a blind wherein a head box can easily be mounted without being hindered by a slat mounting member.

A further object of the invention is to provide a blind wherein an operating rod can be operated smoothly without being subjected to interference of a cover slat with which a head box is covered.

Other and further objects of the invention will become obvious upon understanding of the illustrative embodiments to be described hereinafter or indicated in the appended claims, and various advantages not referred to herein will occur to one skilled in the art upon employment of the invention in practice.

DETAILED DESCRIPTION OF THE PREFERRED EMBODIMENTS

Figure 1:
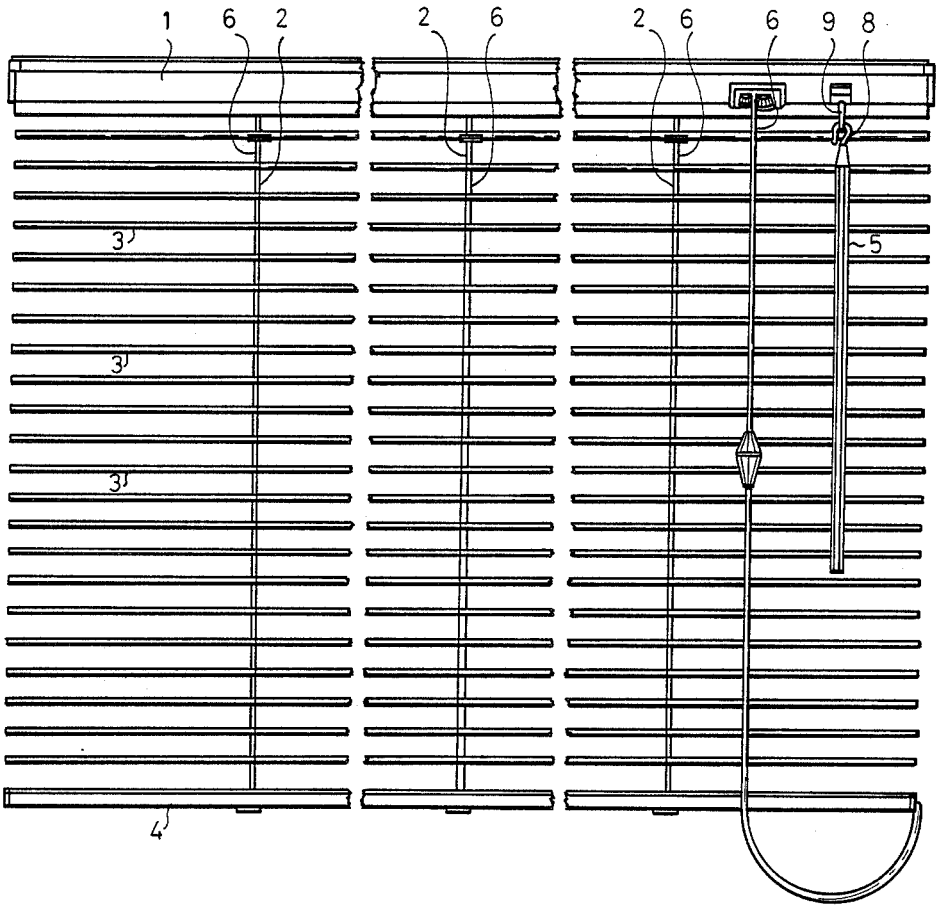
FIG. 1 and FIG. 2 are front views representing a blind entirety which is given in a first embodiment of the invention.

Referring now to a first example embodying the invention according to FIG. 1 to FIG. 17, a blind has a multiplicity of slats 3 hung and supported through three pieces of ladder cords 2 dropped from a head box 1, and a bottom rail 4 is hung and supported on a lowermost stage of the ladder cords 2. An upper end of the ladder cord 2 is supported on an angle control shaft for a slat angle controller 7 to be described hereinlater within the head box 1, and an arrangement is such that each slat 3 can be controlled for angle at equiphase through the ladder cord 2 by turning an operating rod 5 dropped from one side of the head box 1.

Each slat 3 has an elevating cord 6 passed through in the neighborhood of a supporting area of the ladder cord 2, one end of the elevating cord 6 is coupled to the bottom rail 4, and another end is led to one way within the head box 1 and then dropped from a dead weight drop preventer 25 described hereinlater which is mounted on the head box 1 in the neighborhood of the operating rod 5. Then, the elevating cord 6 is operated to move the bottom rail 4 vertically, thereby moving each slat 3 vertically.

Figure 2:
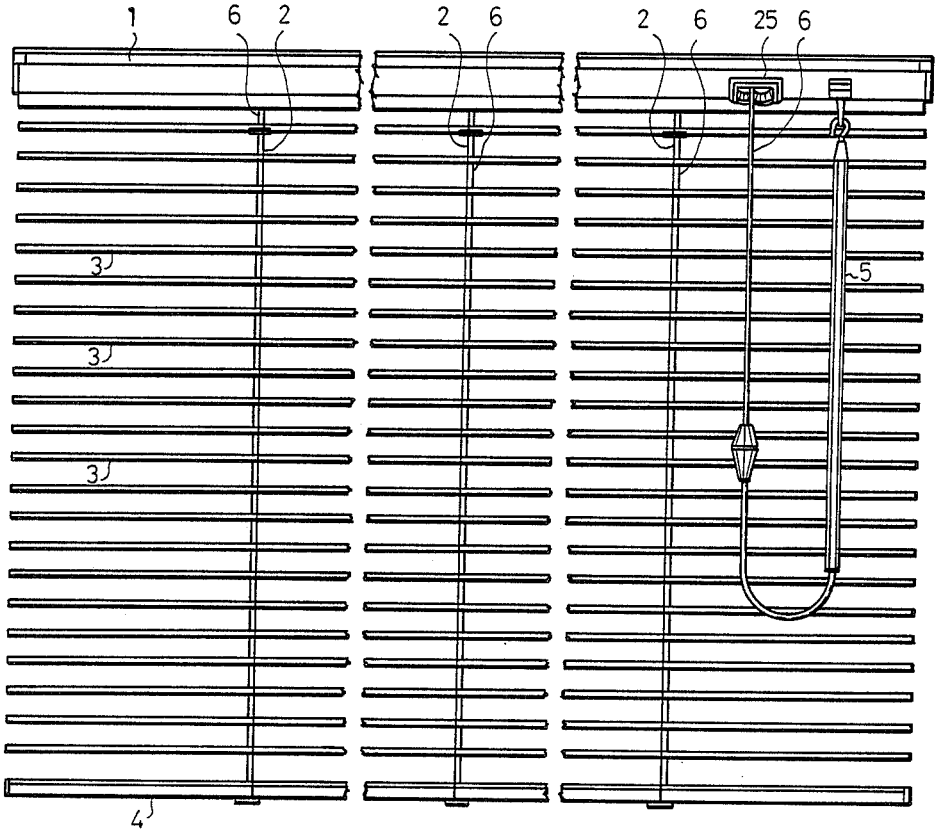

The elevating cord 6 dropped from the dead weight drop preventer 25 has its lower end coupled to the lower end of the operating rod 5 and is dropped to a position near the lower end of the operating rod 5, as shown in FIG. 2, where the bottom rail 4 is got down to the lowermost position.

Referring to a construction of the slat angle controller 7, the operating rod 5 has a hook 8 formed on its upper end, and the hook 8 is put on a first gear shaft 9 of a later-described gear mechanism incorporated in the head box 1. A gear mechanism 10 has its case 11 formed of a synthetic resin, and its front side is protruded forward to form a fitting projection 12. A mounting hole 13 is formed on a mounting portion for the case 11 of the head box 1 covering the side lower portion to the bottom, and the case 11 is incorporated in the head box 1 with the fitting projection 12 of the case 11 fitted in the mounting hole 13 from inside the head box 1.

Figure 4:
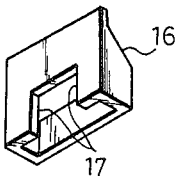
FIG. 4 is a perspective view showing a cap of FIG. 3.

The first gear shaft 9 is protruded slantingly downward from the fitting projection 12 protruded outward of the head box 1, and the hook 8 of the operating rod 5 is put on a coupling hole 14 provided on its nose. A mounting groove 15 is formed on both sides and top of the fitting projection 12 at a position along a outside surface of the head box 1, and a cap 16 formed of a synthetic resin in the same color as the head box 1 and the slat 3 is fitted in the mounting groove 15. As shown in FIG. 4, the cap 16 is formed hollowly and has a recess 17 engagable with the mounting hole 15 formed on the back, and from engaging the recess 17 with the mounting hole 15, the fitting projection 12 is prevented from coming into the head box 1 by the cap 16, and thus the case 11 is prevented from moving in the same direction.

Figure 5:
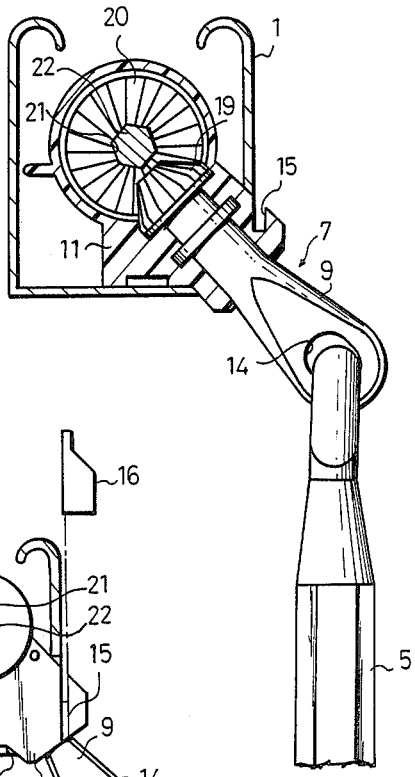
FIG. 5 is a sectional side view of the slat angle controller.
Figure 6:
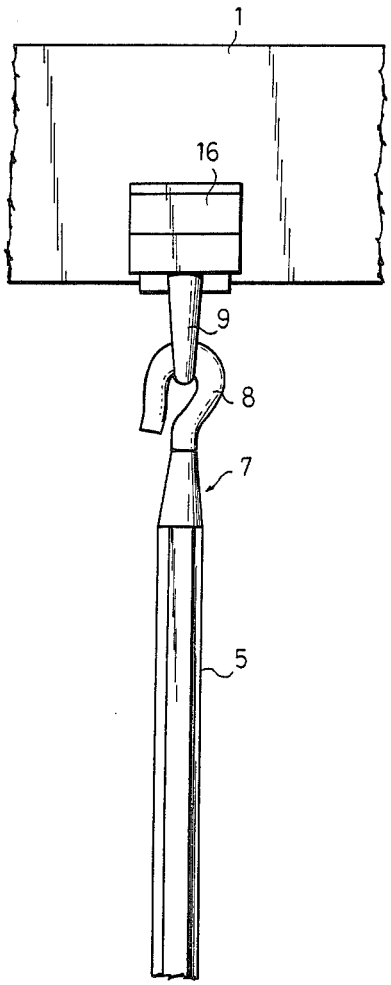
FIG. 6 is a front view of the slat angle controller.
Figure 3:
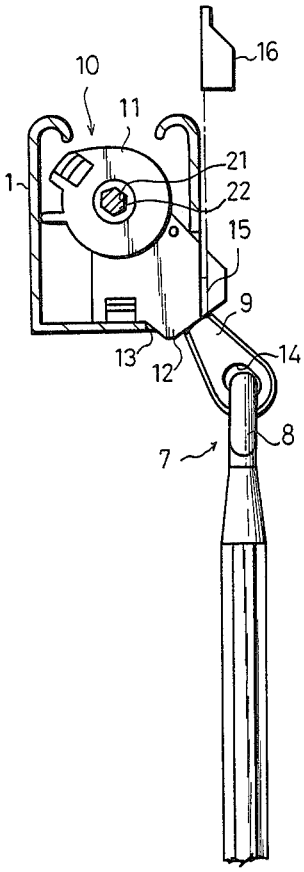
FIG. 3 is a side view showing a slat angle controller of the first embodiment.

A second gear shaft 18 is supported rotatably on the case 11 in a longitudinal direction of the head box 1, and bevel gears 19, 20 are formed integrally on noses of the second gear shaft 18 and the first gear shaft 9 respectively in the case 11, which are engaged with each other. Then, as shown in FIG. 5, the gears 19, 20 are positioned on a bevel of the gear 20. A hexagonal hole 21 is perforated in a shaft center of the second gear shaft 18, and an angle control shaft 22 is inserted in the hexagonal hole 21. Accordingly, from turning the operating rod 5, the angle control shaft 22 is rotated through the first gear shaft 9, the bevel gears 19, 20 and the second gear shaft 18.

Figure 7:
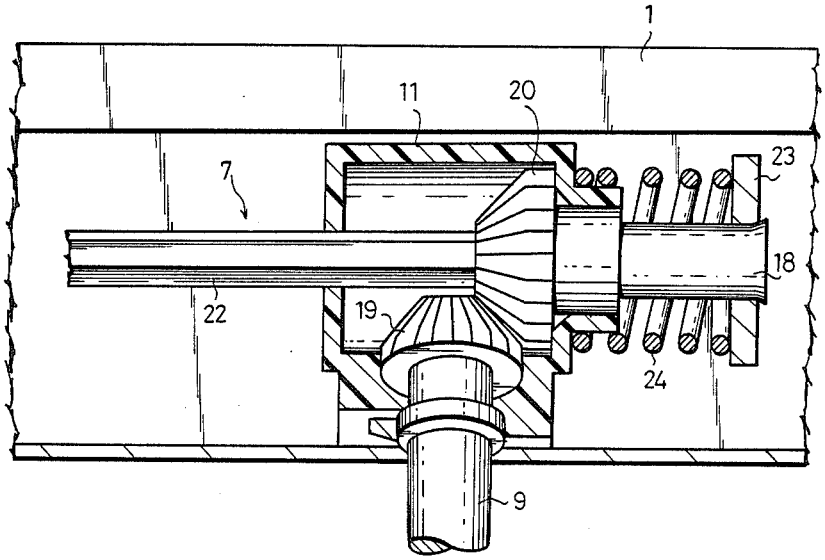
FIG. 7 is a sectional front view, partly enlarged, of the slat angle controller.

As shown in FIG. 7, a base end portion of the second gear shaft 18 is protruded outward of the case 11, a support plate 23 is fitted in the base end, and a coil spring 24 is disposed between the support plate 23 and the case 11. Then, the second gear shaft 18 is energized outward of the case 11 normally through the support plate 23 on a force of the coil spring 24 with the case 11 as a supporting point, and thus the bevel gear 20 is pressed to an inner surface of the case 11. Accordingly, the bevel gear 20 is rotated as rubbing against the inner surface of the case 11 on a torque transferred from the first gear shaft 9.

An action of the slat angle controller 7 mentioned above will be described, next.

Now, for angle control of the slat 3 of the blind, the operating rod 5 is turned one way on an operating force coping with a friction of the bevel gear 20 with the case 11, then the second gear shaft 18 is rotated through the first gear shaft 9, and the angle control shaft 22 is turned. Each slat 3 is then moved slantingly in equiphase through the ladder cord 2. When the operating rod 5 is released after each slat 3 is controlled to a desired angle, some turning force works on the angle control shaft 22 through the ladder cord 2 according to a weight of the slat 3 moved thus slantingly, however, a rotation of the angle control shaft 22 on such turning force is prevented by a frictional force of the bevel gear 20 of the second gear shaft 18 with the inner surface of the case 11, therefore each slat 3 is retained stably at a desired angle.

As described, since the first gear shaft 9 which is driven by the operating rod 5 and the second gear shaft 18 coupled to the angle control shaft 22 are coupled through the bevel gears 19, 20, the one bevel gear 19 can be positioned on the other bevel gear 20 as shown in FIG. 5, therefore a space in the head box 1 can be utilized effectively, and such gear mechanism 10 of the slat angle controller according to the example can easily be contained even in the miniaturized head box 1.

On the other hand, the gear mechanism 10 has the fitting projection 12 of its case 11 fitted in the mounting hole 13 from inside the head box 1, therefore a move of the case 11 in the directions outward and horizontal of the head box 1 is regulated by the mounting hole 13. Then, a move of the case 11 in the direction inward of the head box 1 is regulated by the cap 16 fitted in the fitting projection 12. Accordingly, the case 11 is fixed unmovably to the head box 1 and hence is never moved by operation of the operating rod 5. Further, the cap 16 fitted in the fitting projection 12 protruded from the head box 1 is formed in the same color as the head box 1 and the slat 3, therefore it is capable of enhancing an appearance of the blind to cover the fitting projection 12.

Then, instead of engaging the first and second gear shafts 9, 18 through the bevel gears 19, 20 as mentioned, a gear like a screw gear, for example, wherein the first gear shaft 9 is positioned diagonally of the head box 1 to engage with the second gear shaft 18 may be used.

Figure 8:
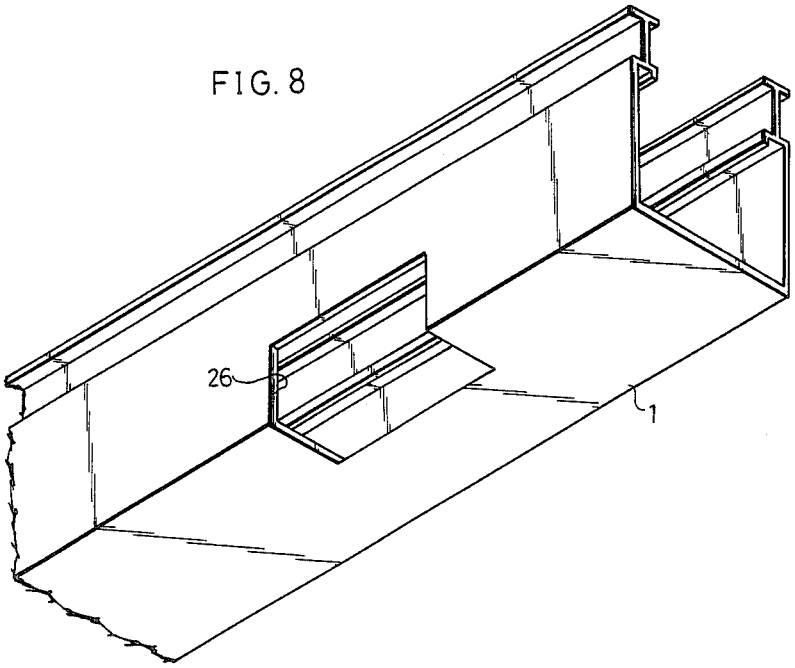
FIG. 8 is a perspective view showing the state wherein a dead weight drop preventer mounting hole of the first embodiment is provided in a head box.
Figure 9:
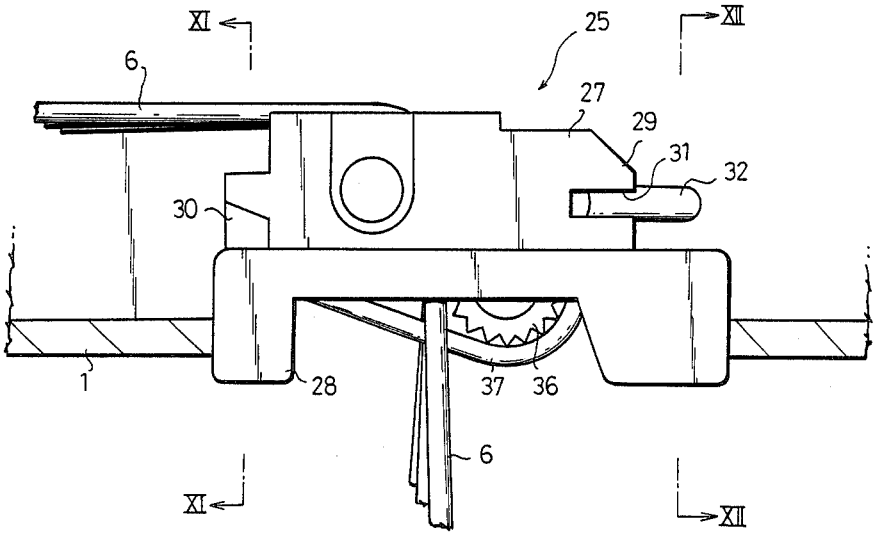
FIG. 9 is a front view of the dead weight drop preventer.
Figure 10:
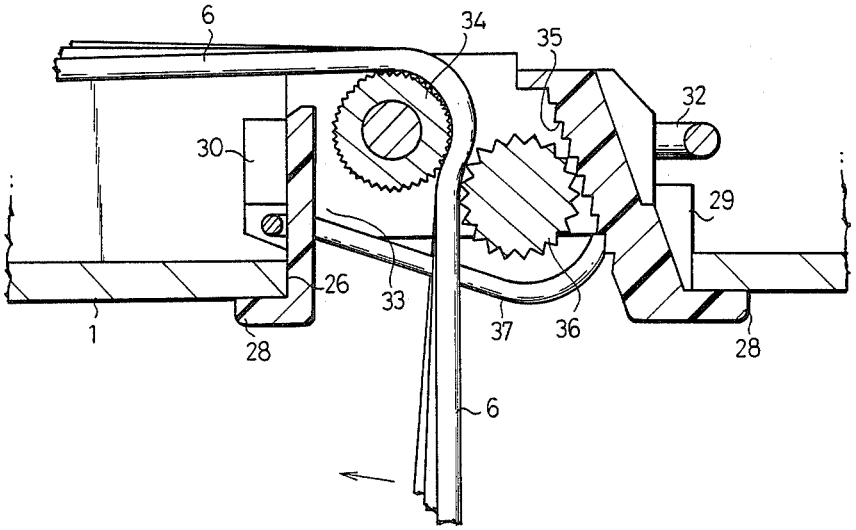
FIG. 10 is a longitudinal sectional view of the dead weight drop preventer.

Next, referring to a structure of the dead weight drop preventer 25, there is formed a mounting hole 26 for mounting the dead weight drop preventer 25 on one end of the head box 1, as shown in FIG. 8, at a corner covering the front to the bottom. The dead weight drop preventer 25 mounted through the mounting hole 26 has an external piece 28 formed on the lower portion of a body 27 formed of a synthetic resin as shown in FIG. 9 and FIG. 10, and an insertion part 29 is formed integrally over the external piece 28. Then, the insertion part 29 is formed to the size that it can be inserted in the mounting hole 26 from under the head box 1, the external piece 28 is formed to the size that it cannot be inserted in the mounting hole 26, and thus when inserted in the mounting hole 26, the external piece 28 will come in contact with an outer surface of the head box 1, as shown in FIG. 8, around the mounting hole 26.

Figure 11:
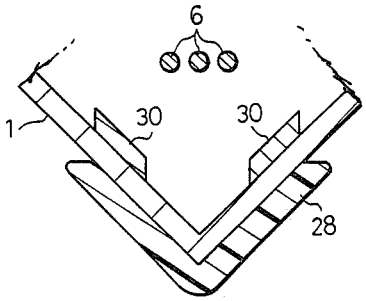
FIG. 11 is a sectional view taken on line I—I of FIG. 9.

There are protruded, on one side of the insertion part 29, a pair of support pieces 30 separated from the external piece 28 by a wall thickness of the head box 1, and when the insertion part 29 is inserted in the head box 1 with the head box 1 inserted between the support pieces 30 and the external piece 28, as shown in FIG. 10 and FIG. 11, one side of the body 27 will be supported on the head box 1.

Figure 12:
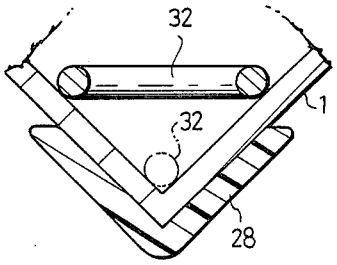
FIG. 12 is a sectional view taken on line II—II of FIG. 9.
Figure 13:
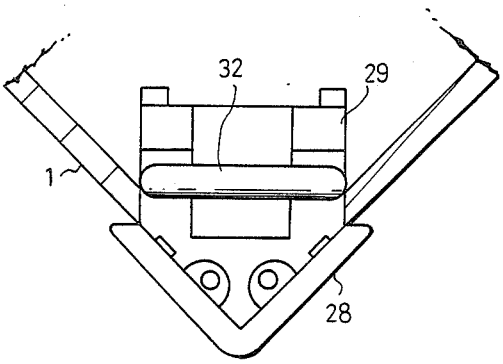
FIG. 13 is a side view of the dead weight drop preventer

A pair of fitting holes 31 as a fitting area are formed on both longitudinal sides of the other side of the insertion part 29, and a nose portion of a channel-like locking pin 32 is fitted in the fitting hole 31. Then in the state where the insertion part 29 is inserted in the head box 1, a base end portion of the locking pin 32 comes in contact with an inner surface of the head box 1 as shown in FIG. 12, and thus the other side of the body 27 will be supported on the head box 1.

A roller enclosing part 33 is provided vertically at the center of the body 27, and a stationary roller 34 is supported rotatably on one side of the upper portion in the roller enclosing part 33. A guide slope 35 with a tongued-and-grooved face like saw blade in section is formed on the other side of the roller enclosing part 33 at a plane inclined downward. Then, a moving roller 36 is disposed between the guide slope 35 and the stationary roller 34, and the moving roller 36 is prevented from falling downward of the roller enclosing part 33 on a distributing pin 37 with both ends supported on the body 27 at a lower portion of the roller enclosing part 33. The moving roller 36 is then formed of a stainless sintered alloy superior in wear resistance, thereby enhancing a durability.

To the dead weight drop preventer 25 configured as above, the three pieces of elevating cords 6 led to one side in the head box 1 are dropped downward of the head box 1 between the stationary roller 34 and the moving roller 36, and when the elevating cords 6 are drawn into the head box 1 due to a weight of the slats 3 and the bottom rail 4, the moving roller 36 moves upward along the guide slope 35 according to the move, the elevating cords 6 are caught between both rollers 34, 36 to move no more as shown in FIG. 10, and thus the bottom rail 4 is hung and so supported at an arbitrary position.

Then, from pulling the elevating cords 6 somewhat downward from the state where the elevating cPords 6 are caught between both rollers 34, 36 as shown in FIG. 10, the moving roller 36 is moved downward along the guide slope 35, and when the elevating cords 6 are pulled further downward from the state mentioned above, the bottom rail 4 can be pulled upward to an arbitrary position, and from pulling the elevating cords 6 in the direction indicated by an arrow in FIG. 10, the elevating cords 6 are drawn into the head box 1, and thus the bottom rail 4 can be lowered to an arbitrary position.

Now, referring to a mounting procedure of the dead weight drop preventer 25 configured as above on the head box 1, the stationary roller 34 is mounted beforehand in the roller enclosing part 33 of the body 27, and the moving roller 36 is supported in the roller enclosing part 33 on the distributing pin 37. Then, one side, i.e. a side of the support piece 30, of the insertion part 29 of the body 27 is inserted in the head box 1 through the mounting hole 26, and the head box 1 is inserted between the support piece 30 and the external piece 28 as shown in FIG. 8, then one side of the body 27 is supported on the head box 1 as shown in FIG. 9.

When the other side of the insertion part 29 is inserted in the head box 1 from such state to bring the external piece 28 into contact with the outer surface of the head box 1, and the locking pin 32 is fitted in the fitting hole 31, a base end portion of the locking pin 32 comes in contact with the inner surface of the head box 1 as shown in FIG. 12, and the other side of the body 27 is supported on the head box 1.

Accordingly, the dead weight drop preventer 25 is ready for charging the moving roller 36 beforehand in the roller enclosing part 33 of the body 27 securely with the distributing pin 37 outside the head box 1, and is also ready for mounting on the head box 1 by fitting the locking pin 32 in the fitting hole 31 on the other side of the insertion part 29 with the support piece 30 on one side of the insertion part 29 engaged with the inner surface of the head box 1. Then, since the fitting hole 31 is formed only on the other side of the insertion part 29, the fitting hole 31 will never interfere with a bearing portion of the stationary roller 34, and thus no space in which to provide the fitting hole 31 will have to be secured from enlarging the body 27 for avoiding the interference.

Then, instead of mounting the dead weight drop preventer 25 on the head box 1 by means of the channel-like locking pin 32, the locking pin 32 which is shaped like a rod otherwise may be fitted in the insertion part 29 at a corner of the head box 1 as indicated by a chain line in FIG. 12.

A structure of the bottom rail 4 will be described, next.

The bottom rail 4 has an opening 38 provided on the top covering on its overall length, and an opening edge 39 bent downward is formed on both sides of the opening 38. The opening edge 39 is effective in enhancing a strength of the bottom rail 4, and, as shown in FIG. 14, even if the elevating cord 6 inserted in the bottom rail 4 happens to contact with the opening edge 39, then the opening edge 39 receives the elevating cord 6 on the face, and thus the elevating cord 6 can be prevented from being damaged thereby.

In a mounting member 40 for mounting the elevating cord 6 on the bottom rail 4, a locking piece 42 protruding in angle upward is formed integrally on a baseplate 41 formed almost same in width as a bottom of the bottom rail 4, and a locking groove 44 for locking the elevating cord 6 therein is provided on a horizontal zone 43 of the locking piece 42. Then, a locking groove 45 for inserting a lower end portion of the ladder cord 2 is provided on the upper surface of the baseplate 41.

Figure 14:
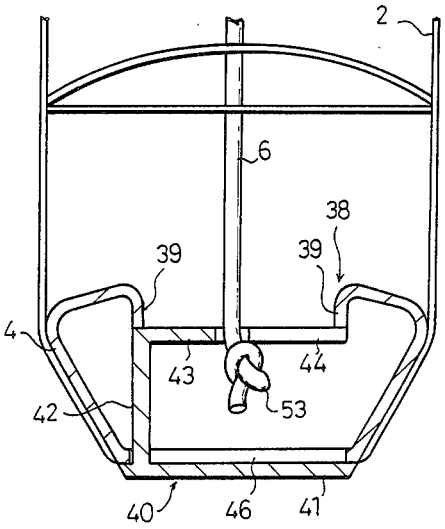
FIG. 14 is a sectional view showing the working state of an elevating cord locking device of the first embodiment.
Figure 15:
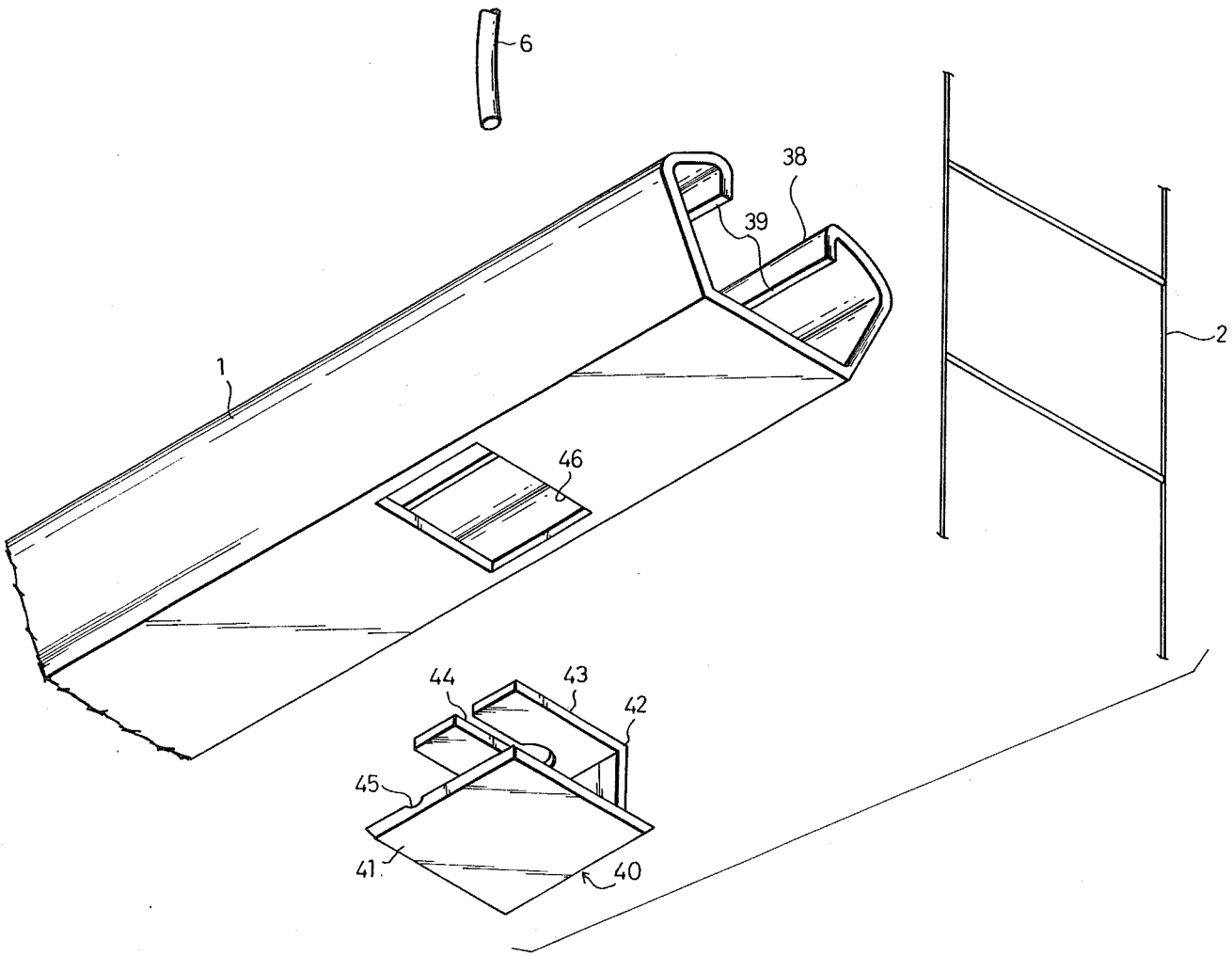
FIG. 15 is an exploded perspective view of the locking device.

A locking hole 46 is formed at a predetermined position of the bottom of the bottom rail 4, which is ready for inserting the locking piece 42 of the mounting member 40, as shown in FIG. 14. Then, when the locking piece 42 is inserted into the bottom rail 4 until the baseplate 41 of the mounting member 40 comes in contact with the bottom of the bottom rail 4 as shown in FIG. 14, a top of the locking piece 42 comes in contact with a lower end of the opening edge 39 of the bottom rail 4.

Now, for locking the elevating cord 6 on the bottom rail 4 by means of the mounting member 40 and the bottom rail 4 described as above, first a knot 53 is formed on a nose of the elevating cord 6, and the nose is inserted in the locking hole 46 from over the bottom rail 4. Then, it is inserted in the locking groove 44 of the mounting member 40, as shown in FIG. 14, under the bottom rail 4, and the locking piece 42 of the mounting member 40 is inserted in the locking hole 46 of the bottom rail 4 upwardly as holding the ladder cord 2 between the locking groove 45 of the mounting member 40 and the bottom of the bottom rail 4, then the baseplate 41 of the mounting member 40 comes in contact with the bottom of the bottom rail 4 as shown in FIG. 14, therefore the bottom rail 4 is hung and so supported on the elevating cord 6 through the mounting member 40, and a lower end portion of the ladder cord 2 is locked on the bottom rail 4.

Accordingly, in such elevating cord locking structure, the knot 53 is formed beforehand on a lower end of the elevating cord 6, and then the elevating cord 6 is inserted in the locking hole 46 of the bottom rail 4 and engaged with the locking groove 44 of the mounting member 40, thereby locking the lower end of the elevating cord 6 easily on the bottom rail 4, and a lower end portion of the elevating cord 6 is enclosed in the bottom rail 4 and never exposed to a lower surface of the bottom rail 4 in this case, thus spoiling a blind looking no more.

The mounting member 40 can be configured otherwise as follows.

Figure 16:
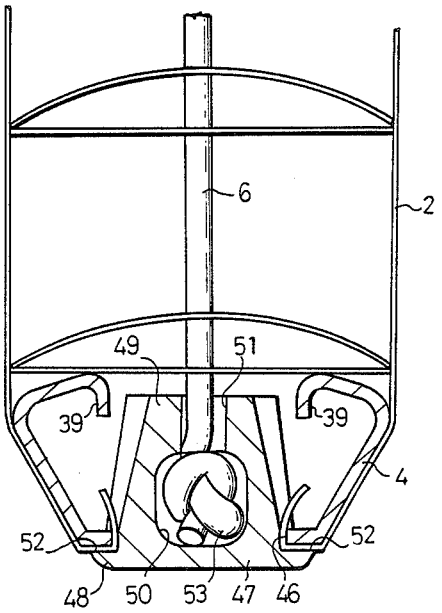
FIG. 16 is a sectional view showing the working state of another example of the locking device.
Figure 17:
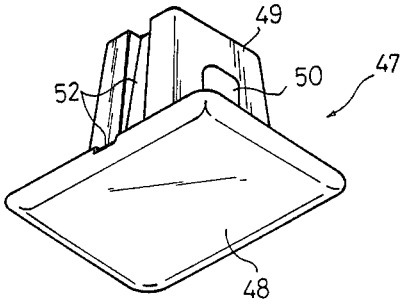
FIG. 17 is a perspective view showing the other example of the locking device.

For a mounting member 47 in this case, a locking part 49 trapezoidal to protrude upward is formed integrally at the center of a baseplate 48 formed almost same in width as the bottom width of the bottom rail 4, and an enclosing recess 50 is formed horizontally through the locking part 49. Then, as shown in FIG. 16, the enclosing recess 50 is opened to a top of the locking part 49 through an insertion hole 51 for inserting the elevating cord 6 therein. A locking groove 52 for locking a lower end portion of the ladder cord 2 is provided on two faces of the locking part 49 where the enclosing recess 50 is not passed through, and the locking groove 52 is extended onto both faces of the baseplate 48 corresponding to the two faces of the locking part 49 where the locking groove 52 is provided.

Then, for locking the elevating cord 6 on the bottom rail 4 by means of the mounting member 47 and the bottom rail 4 configured as above, first a nose of the elevating cord 6 is inserted downward in the locking hole 46 of the bottom rail 4, the nose is then inserted downward in the insertion hole 51 of the mounting member 47 and extracted outward of the enclosing recess 50, and the knot 53 is formed on the nose. Then, from pulling upward the elevating cord 6 exposed from the insertion hole 51 of the mounting member 47, the knot 53 is drawn into the enclosing recess 50, and when the locking part 49 is inserted in the locking hole 46 of the bottom rail 4 as holding the ladder cord 2 between the locking groove 52 of the locking part 49 and an end edge of the locking hole 46, the baseplate 48 of the mounting member 47 comes in contact with the bottom of the bottom rail 4 as shown in FIG. 16, therefore the bottom rail 4 is hung and so supported on a lower end portion of the elevating cord 6 through the mounting member 47, and a lower end portion of the ladder cord 2 is locked on the bottom rail 4.

Accordingly, in such elevating cord locking structure, the lower end portion of the elevating cord 6 is enclosed in the bottom rail 4 and never exposed to the lower surface of the bottom rail 4 under the state where the bottom rail 4 is hung and supported on the elevating cord 6, therefore a looking of the blind will not be spoiled, and the lower end of the elevating cord 6 is inserted in the locking hole 46 of the bottom rail 4 and the insertion hole 51 of the mounting member 47 and then the knot 53 is formed thereon at the time of assembling, and from inserting the locking part 49 of the mounting member 47 in the locking hole 46 of the bottom rail 4 under the state above, the bottom rail 4 can easily be hung and supported on the elevating cord 6. Further, from inserting the locking part 49 of the mounting member 47 in the locking hole 46 of the bottom rail 4 under the state where the knot 53 is positioned in the enclosing recess 50, it can be assembled without loosening the elevating cord 6 in the mounting member 47 as the knot 53 is retained in the enclosing recess 50.

Next, a second example embodying the invention will be described according to FIG. 18 to FIG. 22.

Figure 18:
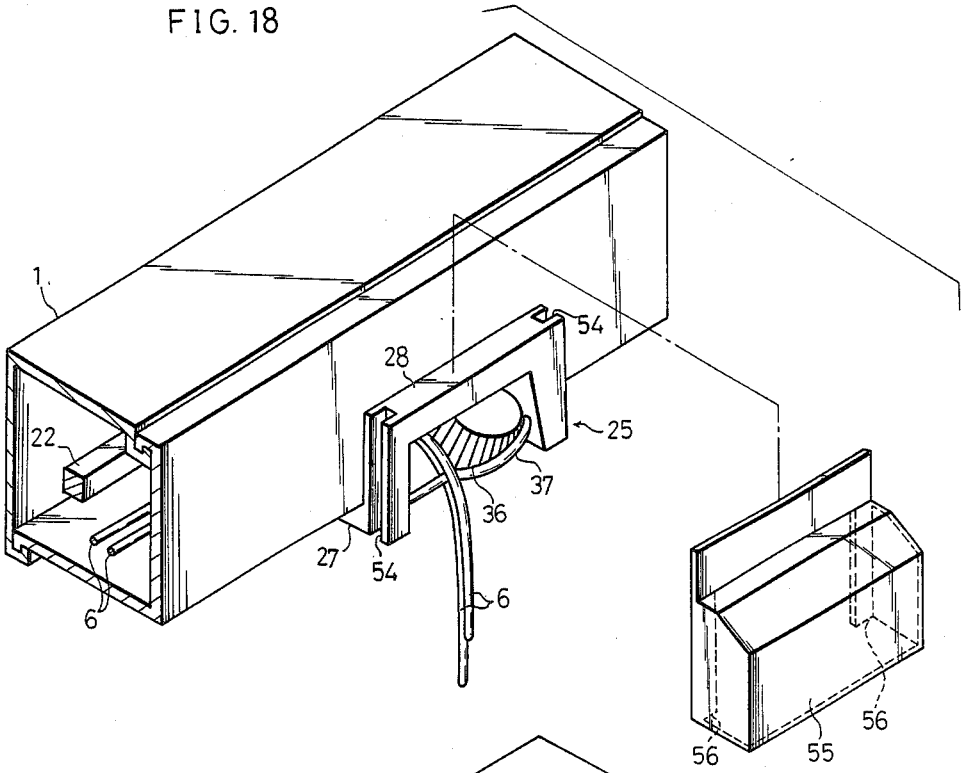
FIG. 18 is a perspective view showing a cover of a second embodiment.
Figure 19:
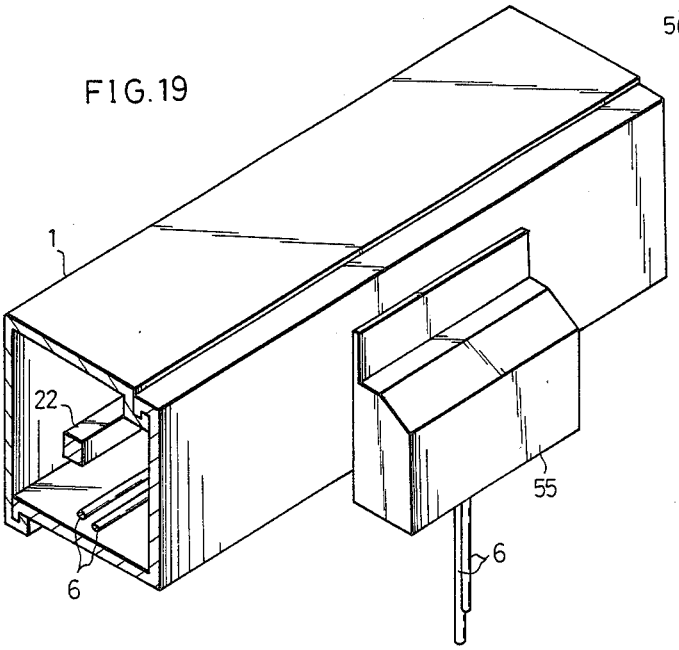
FIG. 19 is a perspective view showing the state wherein the cover is mounted on a head box.
Figure 20:
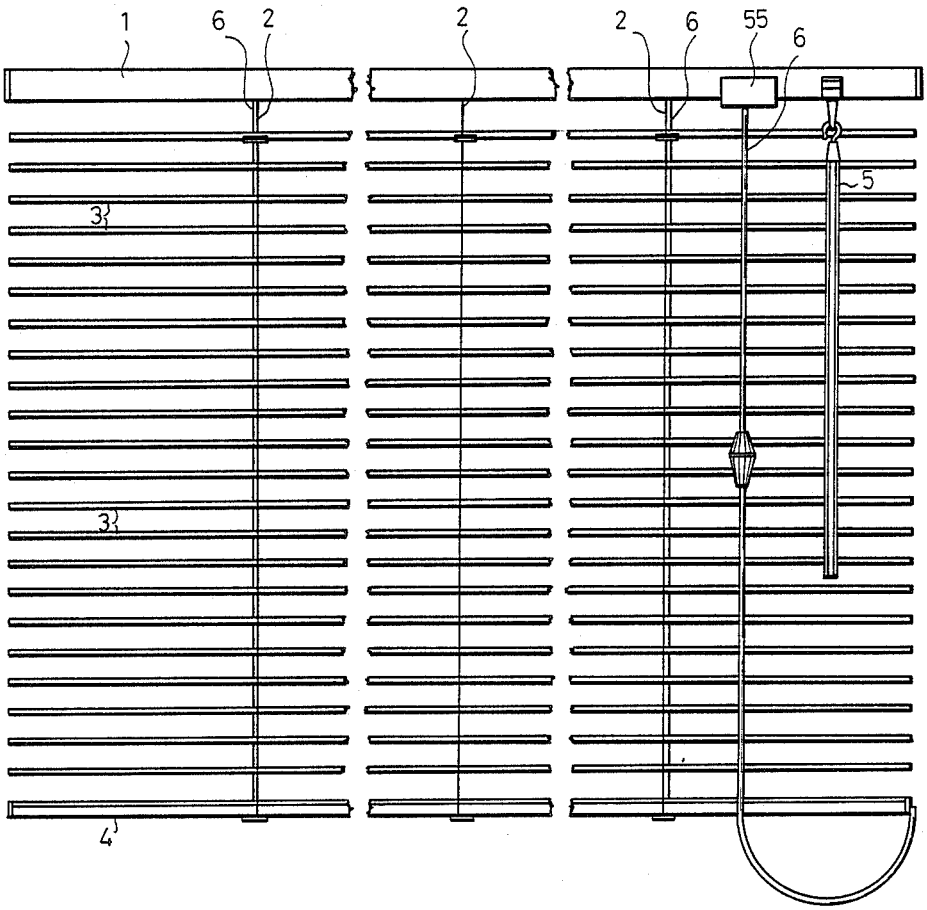
FIG. 20 is a front view representing the blind in entirety with the cover mounted thereon.

First, as shown in FIG. 18, a mounting groove 54 is provided on both sides of the front of the external piece 28 of the dead weight drop preventer 25, and a projection 56 formed on the back of a detachable hollow cover 55 is engagable with the mounting groove 54. From engaging the projection 56 with the mounting groove 54, the dead weight drop preventer 25 is covered with the cover 55 as shown in FIG. 19.

In the above-described blind, the dead weight drop preventer 25 is covered with the cover 55 engaged with the mounting groove 54 of the body 27. Then, the cover 55 is same in color as the head box 1 and the slat 3, therefore the metallic-colored dead weight drop preventer 25 is hidden and thus an interior looking can be enhanced.

Figure 21:
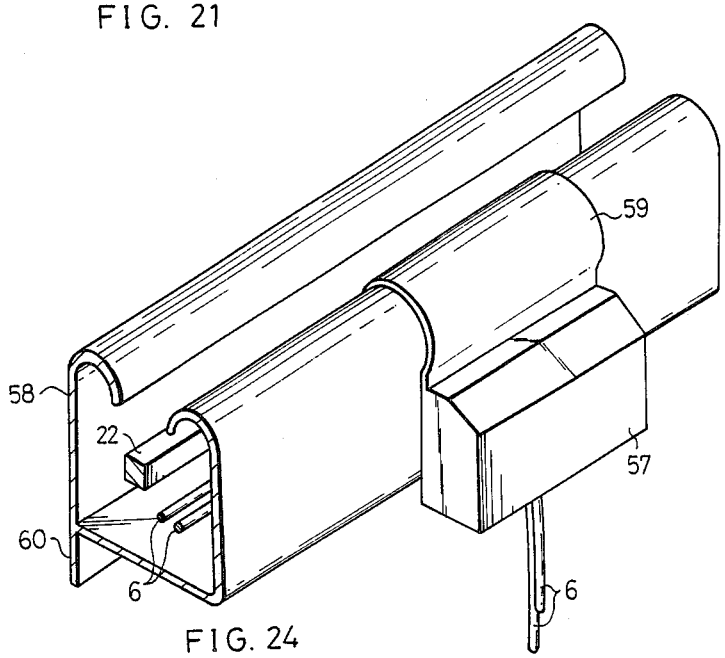
FIG. 21 is a perspective view showing the state wherein another example of the cover is mounted on the head box.

The above-described blind is structured such that the cover 55 has the projection 56 engaged with the mounting groove 54 of the dead weight drop preventer 25, however, it may be structured otherwise that an engaging part 59 engagable with an upper edge of a head box 58 is provided on an upper portion. of a cover 57 as shown in FIG. 21, and the cover 57 is mounted on the head box 58 through the engaging part 59. In this case a screening plate 60 is provided on a lower portion of the back of the head box 58, and a clearance to arise between the uppermost stage slat 3 and the head box 58 when the slat 3 is closed full is screened by the screening plate 60, thereby preventing a leak of the external light.

Figure 22:
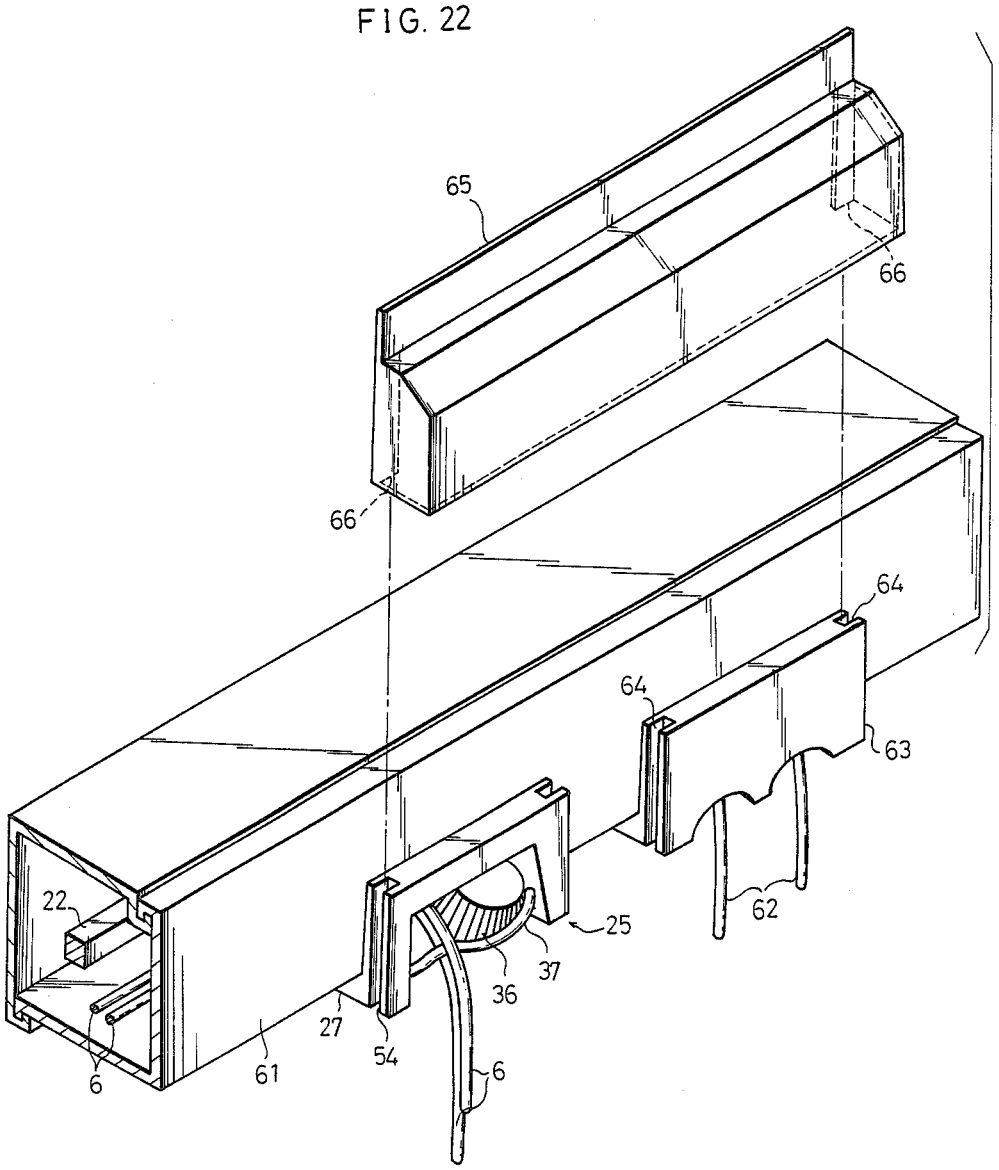
FIG. 22 is a perspective view showing the other example of the cover.

Then, as shown in FIG. 22, an angle controlling cord guide apparatus 63 dropping an angle controlling cord 62 wound on an angle control pulley (not indicated) fixed on the angle control shaft 22 is provided at a position near the dead weight drop preventer 25 in front of a head box 61 instead of the angle controller 7, a mounting groove 64 is formed on both sides of an exposed area of the angle controlling cord guide apparatus 63, projections 66 of a cover 65 for covering both actuators of the dead weight drop preventer 25 and the angle controlling cord guide apparatus 63 are inserted in a mounting groove 64 on one side of the angle controlling cord guide apparatus 63 and the mounting groove 54 on one side of the dead weight drop preventer 25, and thus both the dead weight drop preventer 25 and angle controlling cord guide apparatus 63 can be covered. A separate cover may be mounted otherwise on the dead weight drop preventer 25 and the angle controlling cord guide apparatus 63 each.

Further, the cover 55 is not necessarily limited to the same color as the head box 1 and the slat 3, but any combination will be conceivable if a different color is capable of enhancing an appearance, and the cover 55 may function as a decoration according to its color and shape. Further, if a color of the blind is predetermined, then the cover 55 can be fixed undetachably on the head box 1.

Next, a third example embodying the invention will be described according to FIG. 23 to FIG. 26.

Figure 23:
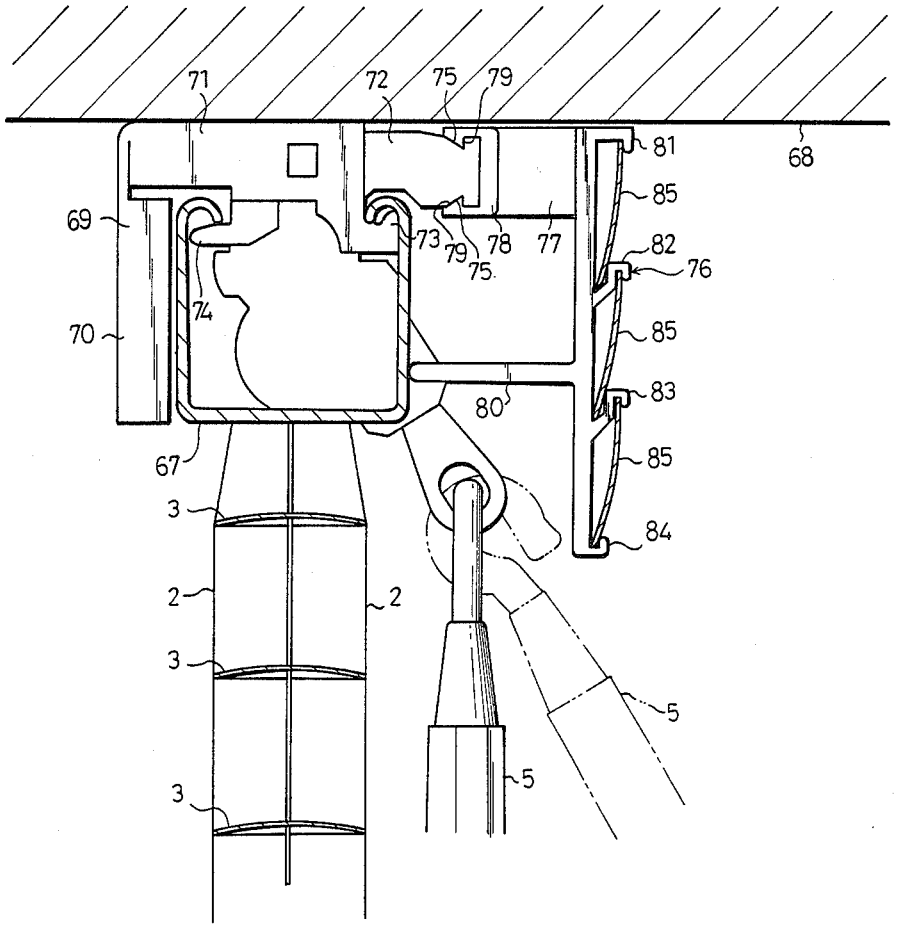
FIG. 23 is a longitudinal sectional view showing the state wherein a head box cover of a third embodiment is mounted on the head box.

As shown in FIG. 23, a head box mounting member 69 for fixing a head box 67 on a ceiling surface 68 comprises a member body 70 shaped like an angle, and a holding member 72 inserted and supported in a cross piece 71 fixed on the ceiling surface 68 in the member body 70. A support claw 73 for locking the head box 67 is provided on a nose of the cross piece 71 of the member body 70, and a support claw 74 for locking the head box 67 through cooperation with the support claw 73 of the cross piece 71 is provided on a nose of the holding member 72 on a side inserted in the cross piece 71. Then, a locking groove 75 as a locking part is formed on both upper and lower surfaces of another end portion of the holding member 72.

Figure 24:
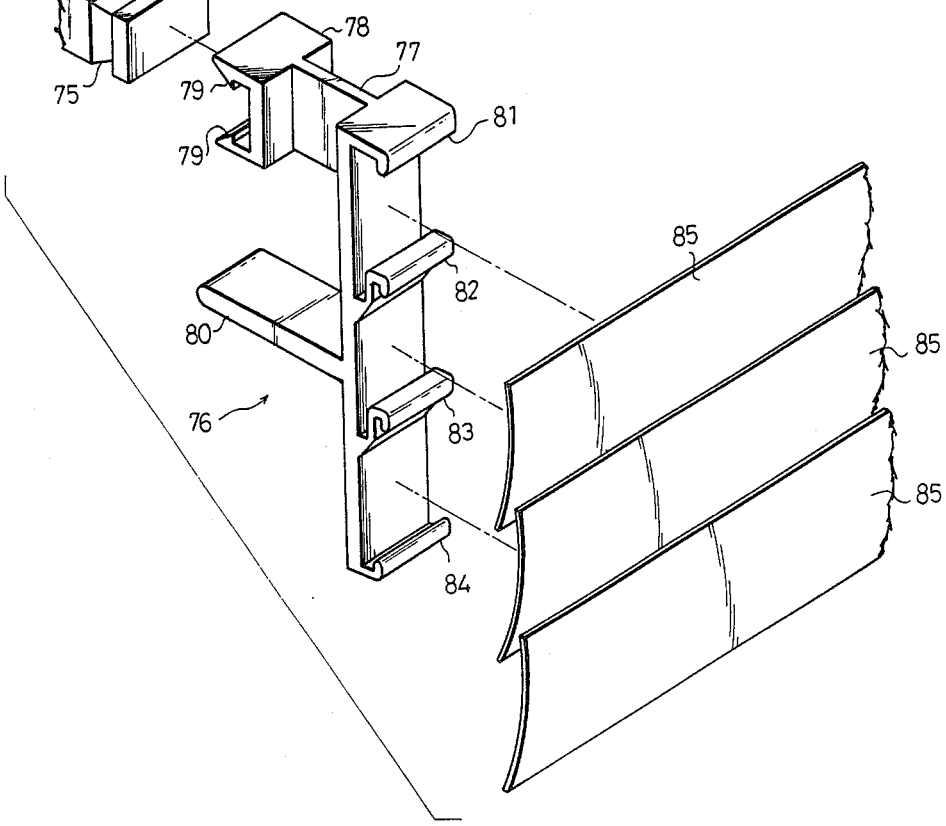
FIG. 24 is an exploded perspective view of the head box cover.

As shown in FIG. 24, a slat mounting member 76 formed of a synthetic resin has an engaging part 78 provided on a side opposite to the head box 67 through a coupling part 77, the engaging part 78 is shaped like a channel in section and has an engaging claw 79 engagable with the locking groove 75 of the holding member 72 provided inside both the upper and lower nose portions. A support projection 80 with the nose coming in contact with the front of the head box 67 is provided at the central portion of the back of the slat mounting member 76 as shown in FIG. 23.

There are formed first to fourth slat supports 81, 82, 83, 84 for supporting the slats longitudinally in front of the slat mounting member 76. That is, the first slat support 81 on an upper end of the slat mounting member 76 has a claw extending downward formed on its nose, and the second and third slat supports 82, 83 under the first slat support 81 have a groove open downward provided on the noses. Further, the fourth slat support 84 on a lower end of the slat mounting member 76 has a claw extending upward formed on its nose. Then, as shown in FIG. 23, repairing slats 85 same in size and color as in the case of the slats 3 hung on the head box 67 can be locked in three pieces longitudinally of the head box 67 among the slat supports 81, 82, 83, 84.

A description will be given next of a mounting procedure of the head box cover consisting of the slat mounting member 76 configured as above and the repairing slats 85 installed on the slat mounting member 76.

From engaging the engaging part 78 of the slat mounting member 76 with the locking groove 75 of the holding member 72 from the state where the head box 67 is fixed on the ceiling surface 68 through the head box mounting member 69, the slat mounting member 76 has its engaging claw 79 fitted in the locking groove 75 and thus is coupled to the head box mounting member 69, and a nose of the support projection 80 comes in contact with the front of the head box 67 to a vertical state. Then, from mounting the repairing slats 85 among the slat locking parts 81, 82, 83, 84 of the slat mounting member 76, there are disposed three pieces of the repairing slats 85, as shown in FIG. 23, ahead of the head box 67. Accordingly, the head box 67 is screened by the slats 85 in such state. Then, when the slats 3 hung on the head box 67 are subjected to angle control under the state above, since there is set a predetermined space between the head box 67 and the repairing slats 85 supported on the slat mounting member 76, the operating rod 5 will never contact with the repairing slat 85 on the lowermost stage even in the state where the operating rod 5 is pulled this side as indicated by a chain line in FIG. 23.

As described, in the head box cover of the example, the slat mounting member 76 can be mounted by engaging the engaging part 78 of the slat mounting member 76 with the locking groove 75 of the holding member 72 with the head box 67 fixed on the ceiling surface 68 through the head box mounting member 69, therefore the slat mounting member 76 will never hinder a mounting work of the head box 67. Then, in the state where the repairing slats 85 are disposed on the slat mounting member 76, the external light is prevented from leaking into a room through a clearance arising between the head box 67 and the slat 3 on the uppermost stage by the repairing slats 85.

On the other hand, the slats 3 hung on the ladder cords 2 and the repairing slats 85 installed on the slat mounting member 67 are of a type and color, therefore a plurality of slats 85 will be installed one upon another, for example, among the slat supports 81, 82, 83, 84 of the slat mounting member 76, and when the slats 3 hung on the ladder cords 2 are damaged for some reason or other, the slats 85 supported on the slat mounting member 76 will be extracted to replacement, thereby repairing the damaged slat 3.

Figure 25:
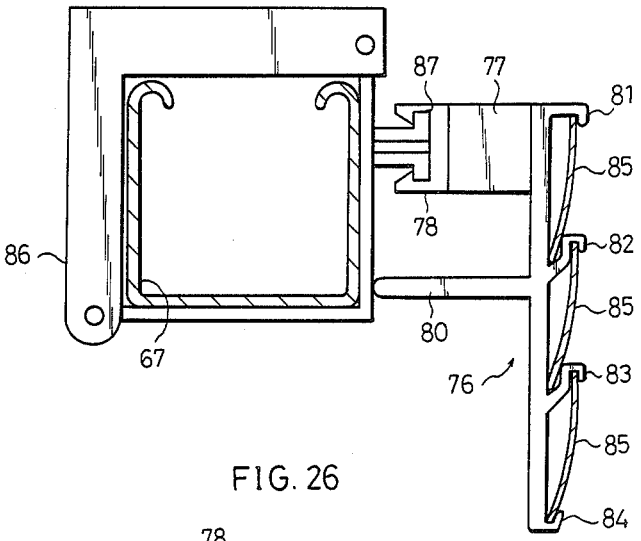
FIG. 25 is a longitudinal sectional view representing another example of the head box cover.
Figure 26:
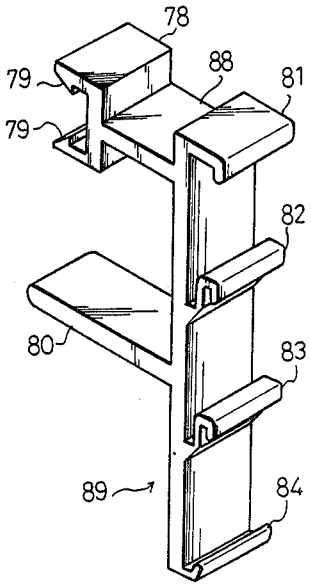
FIG. 26 is a perspective view showing a variant of a slat mounting member of the head box cover.
Figure 29:
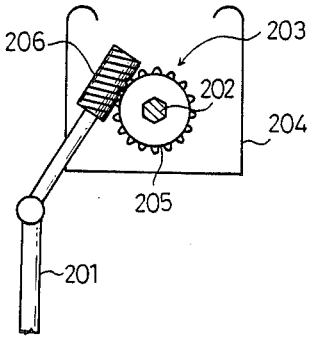
FIG. 29 is a schematic drawing representing a slat angle controller in the Related Art.

Then, as a mounting structure of the head box cover 67, it is conceivable otherwise that in a head box mounting member 86 shown, for example, in FIG. 25, a locking part 87 is provided projectingly in front of the mounting member 86, and the engaging part 78 of the slat mounting member 76 will be fitted in the locking part 87. Further in the example described above, the coupling par 77 of the slat mounting member 76 is provided vertically to the supports, however, where the structure is contrived such that a coupling part 88 is provided horizontally as shown in FIG. 26, the section having such sectional form is cut suitably in a necessary width to each slat mounting member 89.

Next, a fourth example embodying the invention will be described according to FIG. 27 and FIG. 28.

Figure 27:
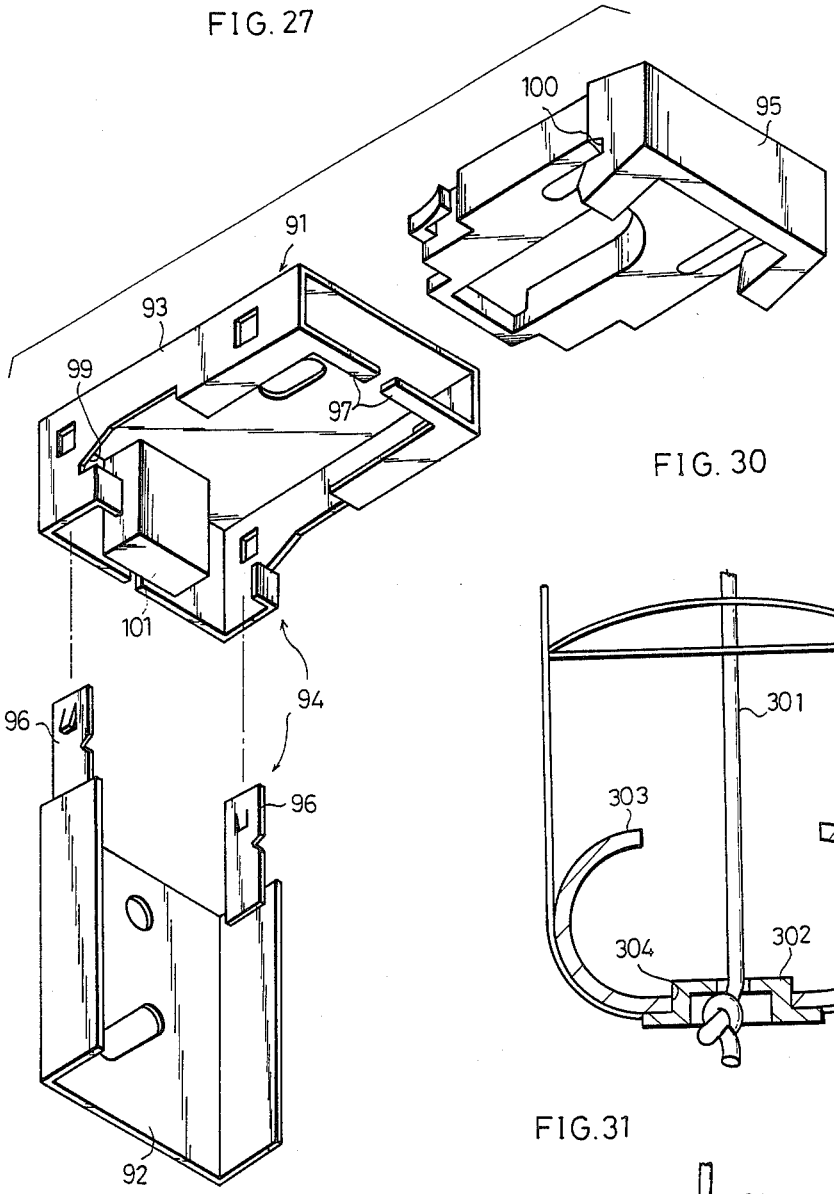
FIG. 27 is an exploded perspective view of a fitting of a head box cover of a fourth embodiment.
Figure 30:
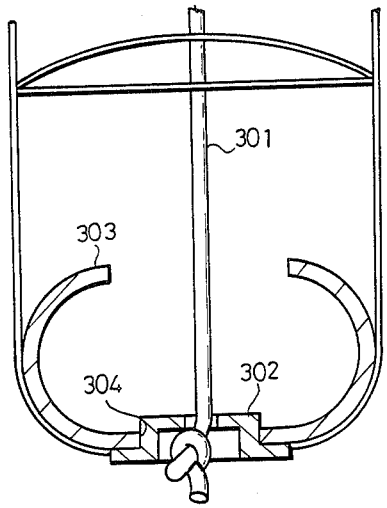
FIGS. 30 and 31 are sectional views representing a slat locking device in the Related Art.
Figure 31:
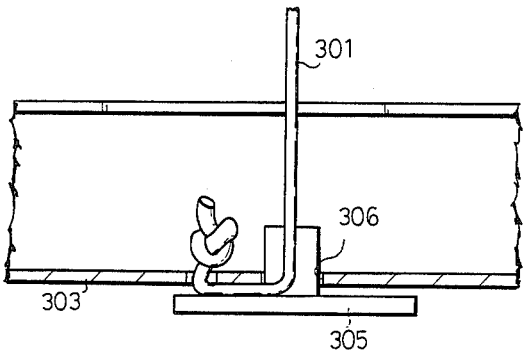

As shown in FIG. 27, a mounting member 91 for fixing a head box 90 at its both ends comprises a member body 94 consisting of a vertical part 92 and a horizontal part 93, and a holding member 95 for supporting the head box 90 through cooperation with the horizontal part 93 of the member body 94. Then, the vertical part 92 is coupled and fixed to the horizontal part 93 to constitute the member body 94 from having locking pieces 96 protruded upward from both the sides inserted in a base end portion of the horizontal part 93, and from inserting a holding member 95 in the horizontal part 93, the holding member 95 is supported by projections 97 on the nose of the horizontal part 93 at a position indicated in FIG. 28, and in such state locking projections 98 on both sides in a cross direction of the upper end of the head box 90 ar supported in a locking recess 99 on a base end portion of the horizontal part 93 and a locking recess 100 on a nose portion of the holding member 95.

As shown in FIG. 27, a sponge 101 is mounted on an inside of the base end portion of the horizontal part 93. Then, in the state where the head box 90 is supported on the member body 94 and the holding member 95 as shown in FIG. 25, a base end portion of the holding member 95 comes in contact with the sponge 101, therefore the holding member 95 is energized in the direction indicated by an arrow in the drawing on an elasticity of the sponge 101 and thus supported securely to the horizontal part 93, and the head box 90 is also energized in the same direction from the one locking projection 98 coming in contact with the sponge 101, therefore it is supported stably without chattering in the locking recess 99 of the holding member 95.

In each mounting member 91 supporting both ends of the head box 90, a slat mounting member 102 formed of a clear synthetic resin is mounted on a nose of the holding member 95. That is, the mounting member 102 has a front piece 103 and a rear piece 104 coupled through a coupling part 105, a pair of engaging claws 106 opposite each other are provided on the rear piece 104 in the cross direction, and the engaging claws 106 are fitted in the holding member 95 on a side not opposite to the horizontal part 93. Then, a lower portion of the rear piece 104 is dropped from the engaging claws 106 and bent toward the head box 90 to form a support projection 107 which comes in contact with the front of the head box 90, and the mounting member 102 is supported by the support projection 107 and the engaging claws 106 ahead of the head box 90.

The front piece 103 of the mounting member 102 is formed so that the lower portion is pushed out to a side not opposite to the head box 90 from the upper portion through a difference in level 108, and slat locking parts 109, 110 for locking slats 113*a*, 113*b* are provided on the upper and lower ends respectively. Then, a support piece 111 for locking the slats 113*a*, 113*b* is protruded slantingly upward from the upper surface of the difference in level 108, and a slat locking part 112 is also provided on a nose of the support piece 111. Further, the slats 113*a*, 113*b* are supported longitudinally between the slat locking part 109 on an upper end of the front piece 103 and a back of the support piece 111 and also between the slat locking part 112 on a nose of the support piece 111 and the slat locking part 110 on a lower end of the front piece 103, respectively.

Now, the head box cover configured as described above is capable of hiding the head box 90 from an interior sight according to the slats 113*a*, 113*b* in two stages vertically which are supported ahead of the head box 90, and a lower edge of the slat 113*b* on the lower stage is positioned below the head box 90, therefore it is also capable of covering a clearance to arise between the uppermost stage slat 3 and the head box 90 when the slats 3 supported on the ladder cords 2 are subjected to angle control vertically.

Figure 28:
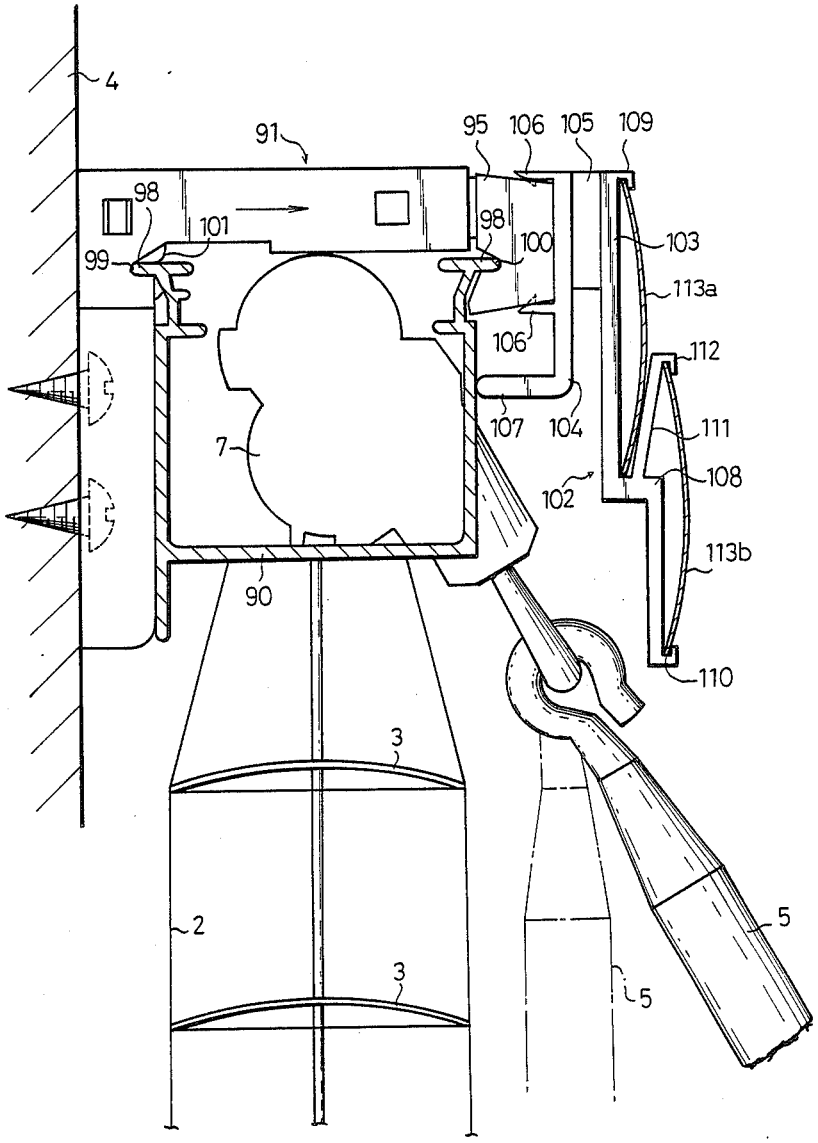
FIG. 28 is a longitudinal sectional view showing the state wherein the head box cover is mounted on the head box.

Then, an angle of the slat 3 may be controlled by turning the operating rod 5, however, a lower portion of the mounting member 102 is pushed out forward and supported at a position where the slat 113*b* on the lower stage does not come in contact with the operating rod 5, therefore if the operating rod 5 dropped vertically as indicated by a chain line in FIG. 28 normally is pulled forward for operation as indicated by a full line in FIG. 28, the operating rod 5 does not come in contact with the mounting member 102 or the slat 113*b* supported on the mounting member 102, and thus the slats 3 supported on the ladder cords 2 can be controlled for angle without trouble.

Then, the above-described example refers to the mounting member 102 for supporting the slats in two stages thereon, however, it can be applied likewise to a mounting member for supporting the slats in three stages or more, and a lower portion of the mounting member can be pushed out slantingly forward. Further, the construction described as above can be applied to a blind wherein the slats are controlled for angle on an angle control cord.

As many apparently widely different embodiments of the invention may be made without departing from the spirit and scope thereof, it is to be understood that the invention is not limited to the specific embodiments thereof except as defined in the appended claims.

What is claimed is:

1. A blind, comprising:

(a) a head box;

(b) an operating rod extending outwardly from one side of said head box;

(c) an angle control shaft in said head box which is driven to rotate by said operating rod;

(d) a multiplicity of slats controlled for angle by rotations of said angle control shaft;

(e) a slat angle controller having a gear mechanism provided between said operating rod and angle control shaft, said gear mechanism comprising a first gear shaft provided with a first gear and extending diagonally insection of said head box, a second gear shaft provided with a second gear, said second shaft being coupled to said angle control shaft and extending longitudinally of said head box, the diagonal extension of said first gear shaft permitting the first gear provided thereupon to be disposed non-interferingly between said second gear and a corner of said head box with said first and second gears meshing so as to couple the gear shafts.

2. The blind as defined in claim 1, further comprising a case for enclosing said gear mechanism therein.

3. The blind as defined in claim 2, wherein said second gear shaft has its base end portion extending outwardly of said gear case, and further comprising a support plate fixed on said base end of said second gear shaft, and a coil spring disposed between said support plate and said case, said coil spring urging said second gear shaft and the support plate fixed thereupon away from said gear case, thereby constantly urging said second gear into frictional engagement with said gear case.

4. The blind as defined in claim 2, further comprising a mounting hole provided on said head box; a front side of said case protruding forwardly to define a fitting projection, said case being installed in the head box with the fitting projection extending outwardly through said mounting hole, said fitting projection being provided with a mounting groove at a position along an outside surface of the head box; and a cap for fixing said case while coming in contact with an outer surface of said head box.

5. The blind as defined in claim 4, said gears being bevel gears.

6. The blind as defined in claim 5, wherein the bevel gear for the first gear shaft is positioned on a bevel of the bevel gear for the second gear shaft.

7. The blind as defined in claim 4, wherein said cap is formed hollowly and provided with a projection engagable with said mounting groove on the back thereof.

8. The blind as defined in claim 4, wherein said cap is tinged with a color in harmony with said head box and slats.

* * * * *